US005118110A

United States Patent [19]

Jones

[11] Patent Number: 5,118,110

[45] Date of Patent: Jun. 2, 1992

[54] LOTTERY SELECT GAME

[76] Inventor: Roy A. Jones, N64 W24065 Ivy Ave., Sussex, Wis. 53089

[21] Appl. No.: 490,074

[22] Filed: Mar. 7, 1990

[51] Int. Cl.[5] ..... A63F 5/04

[52] U.S. Cl. ..... 273/141 R; 273/142 R; 273/142 H; 273/142 HA

[58] Field of Search ..... 273/138 R, 138 A, 139, 273/141 R, 141 A, 142 R, 142 H, 142 HA

[56] References Cited

U.S. PATENT DOCUMENTS

| | | | |
|---|---|---|---|
| 1,594,675 | 8/1926 | Kuhlman | 273/141 R |
| 1,719,723 | 7/1929 | Phillips | 273/141 R |
| 2,322,564 | 6/1943 | Buckley et al. | 273/141 R |
| 2,676,019 | 4/1954 | Steinberg | 273/141 R |
| 3,441,281 | 4/1969 | Pannwitz | 273/142 R |
| 3,559,995 | 2/1971 | Steadman | 273/141 A |
| 3,652,092 | 3/1972 | Boyer et al. | 273/141 R |
| 3,746,344 | 7/1973 | Hodan, III | 273/141 R |
| 3,941,387 | 3/1976 | Mooradian | 273/138 R |
| 4,305,586 | 12/1982 | Richards | 273/274 |
| 4,577,869 | 3/1986 | Brinkman | 273/269 |
| 4,674,748 | 6/1987 | Wismer | 273/141 R |

FOREIGN PATENT DOCUMENTS

| | | | |
|---|---|---|---|
| 2395047 | 2/1979 | France | 273/141 R |

*Primary Examiner*—Edward M. Coven
*Assistant Examiner*—Raleigh W. Chiu
*Attorney, Agent, or Firm*—Andrus, Sceales, Starke & Sawall

[57] ABSTRACT

A lottery selection number game board includes a base board and a plurality of concentric arrays having a common center. A first inner array has twelve spaces, one for the month and the second array has thirty-one spaces, one for each month day. The third and fourth arrays respectively include equispaced spaces, with one including numbers for a large lottery game and the other numbers for a small lottery game. Rotating pointers are mounted on a common center, with one aligned with a month space and the second aligned with the day to identify the users birthdate. A third pointer is mounted for fee spin movement over the two lottery number arrays. The third pointer is manually spun by the player to complete the lottery number array and comes to rest within the number array to identify a number within the array for selecting a lottery number. Sequential spins are made to select a lottery number.

1 Claim, 1 Drawing Sheet

FIG. 1
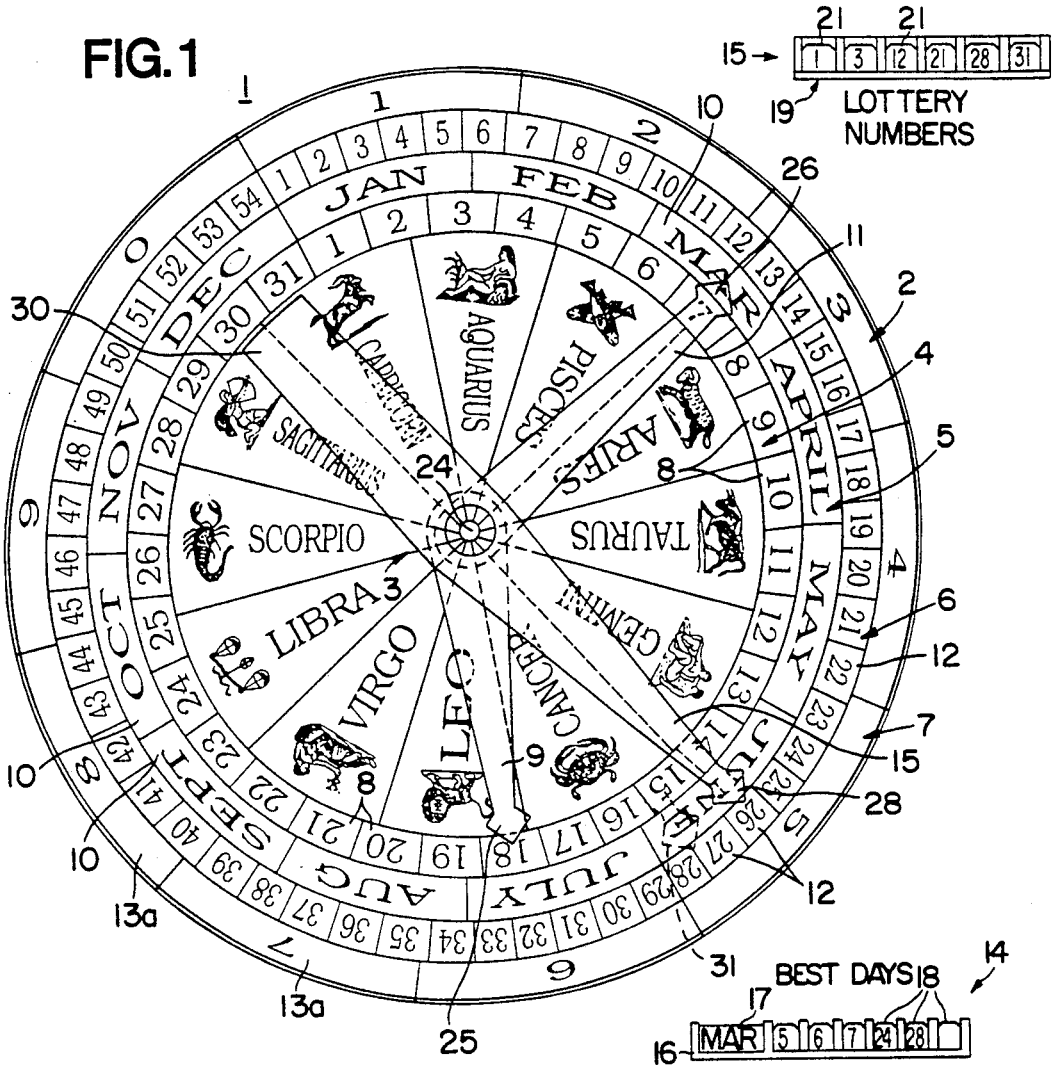
FIG. 2
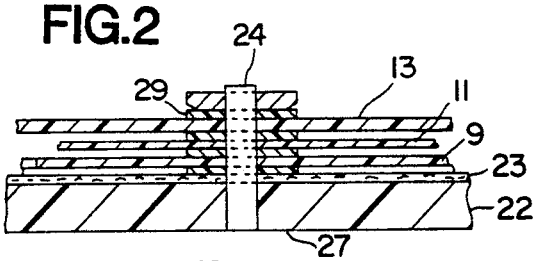
FIG. 4
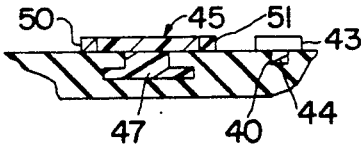
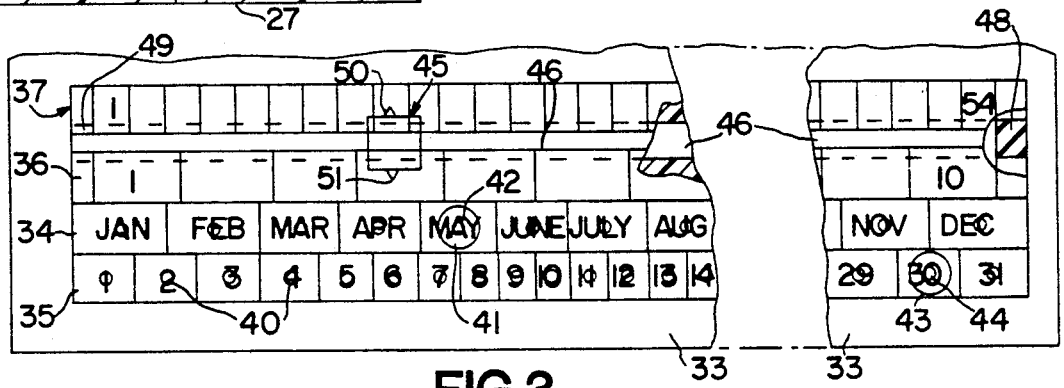
FIG. 3

LOTTERY SELECT GAME

BACKGROUND OF THE PRESENT INVENTION

This invention relates to a lottery number select game and particularly to such a game based on an individual's astrological birth date.

The lottery is available by a number of different governmental entities in the United States and elsewhere. Universally, individuals select numbers, usually four or more, from an assigned pool of numbers. Periodically, a random selection of numbers from the pool are made and those matching that particular selection are declared winners, and generally receive some preadvertised sum of money. Various forms of lottery games are available including those in which a few numbers are selected from a rather small pool of numbers such as daily game. Larger lotteries which award relatively greater sums of money generally require selection of six numbers from a much larger pool. Additionally, a much smaller award will normally be made from such a large pool of numbers for those who have four or five correct numbers of the total winning matching numbers.

Various random computer generators are normally made available for a random selection of numbers by lottery purchasers who do not wish to make a particular selection. Many purchasers will select numbers related to some date of special interest to such purchaser.

The philosphy of astrology relates various individual capabilities to birthdates. Further, in any given period, astrology assumes or assigns certain more significant days and less significant days depending upon astrological theory, and particularly the relative motion of the various planets of the universe. Those individuals who accept the philosophy and understanding of astrology advantageously make decisions based on such information and understanding. Although numbers may be selected by random number generators and/or directly by marking a card, the player's involvement is minimal. In summary, at present there are no particular systems for a player and particularly individuals using astrology to take a more active part in creating his number selection, which would tend to be influenced by events of past significance whether or not they may or may not be particularly advantageously selected at any given time.

SUMMARY OF THE PRESENT INVENTION

The present invention is particularly directed to a game-type device permitting the selection of a series of numbers for playing of a lottery game which involves the game player and based on astrological dates. Generally in accordance with the present invention, a game support includes a plurality of number arrays, with one array including all of the available numbers in a given lottery game. For example, in a generalized lottery employing a periodic draw or selection as well as a daily selection, a first large array will include all of the numbers for the large games while a lesser number array will include all numbers for the daily draw. The game board or support will further include movable two additional arrays, one array for each month of the year and a second array for each day of any month. The player sets his birthdate, with positive identification on the game board of such birthdate. Finally, an arbitrary number selector is provided adapted to scan the game number array or arrays under the controlled activation by the player. The player does not specifically select a particular number but after establishing his birthdate display, physically propells the movable selection device which then scans the game number array. Each actuation results in the selection device settling on a selected number.

In a particularly practical board game unit, a simple playing board of a suitable rigid material is provided. The game display is imprinted or otherwise formed on the board face preferably with each array in a round configuration and arranged in a plurality of concentric informational circular arrays. In a particularly practical system, two othermost circular game number arrays are provided, one of which includes the large number array and within which all numbers for a particular large lottery are displayed in equi-spaced relation. In a preferred embodiment or adjacent array, a lesser array of numbers is provided for a smaller lottery game and are displayed in equi-spaced relation. A day array and a month array are also provided for insertion of the players birth month and day. The arrays are preferably formed as adjacent circular arrays. Individual rotary markers are provided for selecting of the month and the day in accordance with the players birthdate. The selectors can be individual zodiac markers related to the individual birth month and day or maybe simple rotating arrow pointers or other like movable indicia selection elements or devices. Finally, a common selector for limited controlled scanning of the number array is provided secured to the board. Thus, a simple manually actuated rotating arrow or pointer member is preferably secured to the center of the circular array and manually activated to spin and come to rest in alignment with the game number arrays; thereby providing for selection of a number. The game player continues to sequentially spin the number selecting pointer until all numbers have been selected.

As previously noted, the individuals high and low days change each month of the year and from year-to-year. High and low day markers are preferably provided as a part of the board or otherwise to provide for positive selection and identification of the best days for selection of the lottery numbers on the astrologically assigned optimum time.

The present invention is contemplated as providing a personal game board for the individual. In that extent, the month and date means can be provided with some form of a fixed selection. However, as a matter of practical application, it is contemplated that the total month and month day display will be provided so that a single board can be used by each user regardless of the selection of his birthdate and further providing for sharing of the game board if so desired. Additionally, various electrically operated type of systems can be provided using lights or other numerical displays for the month and day selection as well as the number selection arrays. In addition, other manually activated mechanisms can be provided for the scanning of the arrays and the limited controlled number selection similar to that provided by the manual actuation of a rotating or sliding member.

Thus, generally the present invention provides an effective astrogically based method and apparatus for selection of lottery game numbers in an apparatus which can be constructed as a low cost mass produced and fun game.

BRIEF DESCRIPTION OF THE DRAWING FIGURE

The drawing furnished herewith illustrates a best mode presently contemplated for the invention and are described hereinafter.

In the drawings:

FIG. 1 is a top plan view of a game board illustrating an embodiment of the present invention;

FIG. 2 is a vertical section taken generally on line 2—2 of FIG. 1;

FIG. 3 is a top plan view of a similar board illustrating a linear array display system and illustrating a second embodiment of the present invention; and FIG. 4 is a vertical section taken generally on line 4—4 of FIG. 3.

DESCRIPTION OF THE ILLUSTRATED EMBODIMENT

Referring to the drawings and particularly to FIG. 1, a lottery number select game is illustrated in which an essentially rigid board 1 is provided with a information and selection array unit 2 including information for selection of lottery numbers. In the embodiment of FIGS. 1 and 2, a physically actuated and positioned selector unit 3 is located for conjoint action with array unit 2. The information and selection array unit 2 consists of a plurality of four concentric circular arrays 4, 5, 6 and 7, each of which includes particular information which can be custom assigned to a particular user in accordance with his birthdate and thus his astrological assignment. Generally, as illustrated, four circular or ring-like arrays 4, 5, 6 and 7 are incorporated in the selection array unit. The innermost array 4 is shown with thirty-one equicircumferentially spaced spaces 8, each of which incorporates a day of the month. The selector unit 3 includes a movable marker 9, shown as a pivoted pointer, associated with this array 4. The player aligns the marker 9 on his birthday. The next outward spaced circular array 5 includes equicircumferentially spaced spacers 10, including the numbers 1 through 12. A pivoted pointer 11 of unit 3 is provided for identification of the birth month of the user. The placer of course manually places this pointer 11 in alignment with his birth month, and thus has personally identified the board with his birthdate. The next outer array 6 is shown including numbers which are all of the numbers available in a particular large reward lottery game. Typically, 54 number spaces 12 are provided with the number digits 1 through 54. A game number selection marker 13 is mounted for free movement in a limited controlled manner about the two number arrays 6 and 7 for sequential selection of the numbers of a lottery game. The marker 13 is shown as rotating pointer, the outer end of which aligns with the two outer arrays 6 and 7. The spin of the game number pointer 13 is imparted by the player to scan the appropriate array 6 and 7 and come to rest at a particular number which is player selected number. By sequentially spinning the movable pointer 13, all of the numbers in a given game can be selected. The outer array 7 is used for a lesser game system such as a daily lottery where only four or so numbers are required and generally the available spaces and numbers 13*a* are substantially less. The lesser number game system has a greater probability of winning and is obviously operated with a lesser award and tailored to the particular anticipated calculated odds.

Further, the game board 1 includes a "best day" identification section 14 adjacent the circular birthdate and number selection array unit 2.

In the illustrated embodiment, the section 14 includes raised U-shaped frames 16 to receive month and day members. The month frame 16 is an offset or recessed frame within which a month card 17 is releasably secured for the play month. The day frames 16 are similarly formed within which a day card 18 is releasably secured. For each player, the game is provided with 12 month cards 17 conforming to the month frame 16 and a 31 day cards 18 conforming to the day frames. Each month the player inserts the appropriate cards to identify the best days for the current month in accordance with his birthdate.

The play board 1 also includes a lottery number display unit 19 having the number cards in adjacent aligned sections or U-shaped frames 20. A separate frame 20 is provided for each individual number of a largest total lottery number. The player inserts the proper number cards 21, and preferably uses each last winning number as the starting point for selection of a corresponding number in the new lottery number for the next drawing. Thus, the player locates the number pointer 13 aligned with the number of the last winning number. The pointer 13 is spun by the player and the adjacent number from array 6 and 7 inserted in the same frame as the prior spin start location.

The advantage of the game is that the player positively selecting his birthdate, thereby concentrating on his astrological dates, and then actively participates in each number selection with physical input and thus control of the number selector. The user has the enjoyment of the physical participation in the number selection as well as the considered astrological advantage. Of course, the player may play the game as often as desired. Although the game may be advantageously used in connection with actual lotteries, it will be realized that a number of individuals may set up their own lottery game which is played as a social gathering and enjoyment normally associated with various game devices. The game may be provided with play money or other reward means for play with a limited a group of people meeting for a sociable evening. Individual game boards may be used or a single game board may be used with the individuals sequentially rearranging for the board and activating the wheel selection.

More particularly in the illustrated embodiment of the invention, the base board 1 is shown formed with a suitable rigid base 22 formed of plastic, wood, paper board or the like. The display array unit 2 may be imprinted on the board directly, or may be a separate sheet 23 which is attached as an imprinted overlay as illustrated.

In the illustrated embodiment, the selection pointer 9, 11 and 13 are rotatably mounted on a pin 24 at the center of the display unit 2. The pointers 9 and 11 are similarly constructed with an inner end mounted on pin 24 and having an outer pointed ends 25 and 26 overlying day and month circular array 4 and 5, respectively. The month and day pointers 9 and 11 are rotatably mounted on the pin 24 with interposed friction washers 27 and 28 operable to hold the pointers in place. The user is free to pivot the pointers 9 and 11 to align the outer ends 25 and 26 with the selected month and days of his birthdate.

The number selection pointer 13 is for arrays 6 and 7 secured to the pin 24 with the opposite outer ends projecting outwardly and with an outer pointed end 28 closely overlying to the outer day array 7. The pointer 13 is preferably mounted with a suitable bearing support 29, as by a sleeve bearing, on the pin 24 to allow substantially free rotation of the pointer 13 on the pin 24. The back end 30 of pointer 13 extends outwardly to provide a access for spinning the pointer. The user thus grasps or otherwise strikes the outer end to spin the pointer, allowing the pointer to freely rotate and come to rest under its own forces in alignment with a number of arrays 6 and 7. That number is of course recorded as one of the lottery numbers. Should the point end of pointer 13 end up in essentially precise alignment with a dividing line between two adjacent numbers such as shown in phantom at 31, the user may assume the two adjacent numbers are selected, or respin the pointer 13. If the pointer 13 is so centered when a final number is selected, the user can again actuate the pointer 13 or alternatively may assume that either of the numbers are equally acceptable and record either one. By sequentially spinning of the lottery number select pointer, the user sequentially records each of the appropriate lottery numbers from the assigned array. For selection of the daily numbers, the user uses the outer array 7. For a large number game, the user operates uses with the inner lottery number array 6, in the illustrated embodiment.

Various commercial lottery systems of course have different total numbers and thus the game must be custom designed for a particular lottery game. With present games, 54 numbers is the highest. Thus, the game board is preferably made as shown so the board is universally applicable. Alternatively, different overlays can be provided for securement to the board for the different available lotteries. Alternatively, releasably mounted numbers may be provided in each of the arrays to permit custom designing of the unit for the available numbers.

Although shown in a circular array, the operating game can readily similarly constructing as a flat linear board. For example, such as shown in FIGS. 2 or 3.

The month and day selectors are shown as a movable pointers in the first embodiment. If desired, suitable separate markers such as tokens having the appropriate identification number or month thereon. Each token may include a securement peg adapted to mate with the corresponding opening in the appropriate board space, as shown in FIG. 3.

Thus, referring particularly to FIG. 3, an elongated rectangular game board 33 is illustrated having four parallel extended linear information arrays, consisting of a month array 34, an adjacent day array 35, a small number lottery array 36 and a large number lottery array 37. The month and day arrays 34 and 35 include twelve month sections 38 and 31 day sections 39 respectively. Each section 38 and 39 includes a corresponding peg opening 40 in the support base board. A month selection token 41 with a peg 42 is provided for insertion into the month section. Similar number tokens 43 having pegs 44 are inserted in the appropriate openings 40 in the day location. Thus, the markers/tokens can be appropriately inserted into the corresponding locations to select again the user's month or day of birth.

The two number selection arrays 36 and 37 are located in parallel adjacent relation. In the linear illustrated embodiment, a sliding pointer 45 is located within a track 46 between the two arrays. The marker or pointer 45 includes a slide member 47 slidably mounted in the track for relatively free movement along the length there. The opposite end of the track 46 are shown with suitable resilient bumpers 48 and 49 such that when the slide strikes the bumper with any force, the slide rebounds and returns back along the track 46. Thus, the user imparts a linear motion to the pointer and releases it to slide within the track between the ends thereof and comes to rest in alignment with each of the number arrays. The pointer 45 is shown having oppositely overlying pointer ends 50 and 51 respectively aligned with the arrays 36 and 37 to provide for individual and selective alignment with the numbers on the array. The linear embodiment is used essentially as the rotary embodiment, with the user inserting his birthdate on the first two arrays 34 and 35 and then activating the pointer 45 to select the lottery numbers. The numbers for the lottery game are again selected by sequential actuation of the pointer.

In both embodiments, the user physically engages the lottery number selecting pointer and imparts the motion thereto. Generally, the energy imparted to the marker should be controlled by the user so that he actively participates in the selection or the obtaining of each of the lottery numbers. Although a semi-automated system can be provided, the player should still have some control over the force applied to the marker. Thus, for example, an adjustable force member such as a spring loaded device can be coupled to and part of force to the pointer 45 from an initial starting position. The amount of force applied can be controlled through a suitable adjustable setting device. A suitable release mechanism can be incorporated into the system which is actuated by the user again to release the preset force selected by the user which is then imparted to the marker for establishing the movement of the marker.

Further, within the broadest concept of the present invention, various other electrical means and display devices might be provided for inserting the user's birthdate. For example, simple dial switches, digital dial switches may be provided for dialing in the month and day of his birthdate. Again, a digital number display system might be developed with the operator providing a physical controlled motion such as a rotation or a linear motion or a combination thereof which will activate the display to generate one of the numbers within the assigned lottery numbers of a particular lottery game with automatic display of such numbers. Again, in all embodiments of the present invention, the user is required to physically participate by introducing of his birthdate as well as imparting an active and player controlled force to the number selection pointer with sequential operation providing for selection of the total number sequence.

Although the lottery games is disclosed using numbers in accordance with conventional practice, any other type of indicia such as alpha or alpha-numeric identification systems could be used and are considered within the teaching and scope of the invention and described in the claims.

These and other variations will readily occur to those skilled in the art of designing selection devices involving the user based on the teaching of the present invention.

The present invention thus provides a new and novel game which can be played by a group of people by sequentially and repetitively operating a single game board or their own individual game board to select the particular game numbers with the various players operating to select the lottery number against a predetermined or arbitrarily or otherwise selected game number. Although, generally usable by the users for selection of numbers in accordance with large distributed and governmentally run lotteries, the game is equally applicable within the boardest teaching of the present invention to individual lottery games within a smaller group particularly where a lesser group of numbers are selected.

Various modes of carrying out the invention are contemplated as being within the scope of the following claims and particularly pointing out and distinctly claiming the subject matter which is regarded as the invention.

I claim:

1. A horoscopically based lottery game apparatus, comprising a base support structure, a plurality of fixed arrays located on such structure in immediately adjacent location and including a month array including twelve different segments each identified by a different month of the year, a day array adjacent said month array and including thirty-one segments each identified by a number between one and thirty-one, at least one lottery number array, means associated directly with said month array to selectively and separately identify a month, means associated directly with said day array to selectively and separately identify a particular day of the month, and a number selector unit for scanning of said number array for selecting any one of said numbers, a moving control element for controlling the movement of said number selector unit in accordance with the motive force applied thereto and including an input unit permitting the user to control the motive force applied to said number selector unit for selecting of a number from said lottery number array and whereby the user operates said device by selecting his birthdate on said month array and day array and then sequentially actuates said number selector unit for selecting a series of numbers associated with a lottery system; said lottery game apparatus further comprising a best day identification unit including a month section and a plurality of day sections, month and day elements having the different months and month days thereon, said month and day elements being releasably mounted in the month and day sections.

* * * * *